US006297782B1

(12) United States Patent
Matthews et al.

(10) Patent No.: US 6,297,782 B1
(45) Date of Patent: Oct. 2, 2001

(54) MODULAR HUB ARRAY ANTENNA

(75) Inventors: Peter G. Matthews, Gorham; David Kokotoff, Scarborough, both of ME (US)

(73) Assignee: Gabriel Electronics Incorporated, Scarborough, ME (US)

( * ) Notice: Subject to any disclaimer, the term of this patent is extended or adjusted under 35 U.S.C. 154(b) by 0 days.

(21) Appl. No.: 09/625,816

(22) Filed: Jul. 26, 2000

(51) Int. Cl.[7] ..... H01Q 13/10

(52) U.S. Cl. ..... 343/771; 343/770; 333/137

(58) Field of Search ..... 343/767, 770, 343/771, 853, 872, 873; 333/113, 137, 157; H01Q 13/10

(56) References Cited

U.S. PATENT DOCUMENTS

| | | | | |
|---|---|---|---|---|
| 3,803,617 | * | 4/1974 | Fletcher et al. | 343/786 |
| 4,588,962 | * | 5/1986 | Saito et al. | 330/286 |
| 4,716,415 | * | 12/1987 | Kelly | 343/771 |
| 5,291,565 | * | 3/1994 | Schaffner et al. | 385/3 |
| 5,870,063 | * | 2/1999 | Cherrette et al. | 343/853 |
| 6,154,176 | * | 11/2000 | Fathy et al. | 343/700 MS |

* cited by examiner

*Primary Examiner*—Tho Phan
(74) *Attorney, Agent, or Firm*—Bromberg & Sunstein LLP

(57) ABSTRACT

A modular array antenna. The antenna has a plurality of radiating elements fed by a hybrid waveguide/stripline network that includes a waveguide power splitter for coupling power into the stripline network. Components of the array antenna may be substituted for selecting polarization and beamwidth.

4 Claims, 2 Drawing Sheets

MODULAR HUB ARRAY ANTENNA

FIELD OF THE INVENTION

The invention relates generally to a modular antenna array fed by a hybrid network including both waveguide and suspended stripline.

BACKGROUND ART

Radiating elements of antennas for use at wavelengths in the millimeter-to-centimeter range are typically fed either by waveguide or stripline. While exhibiting lower loss, waveguide is significantly larger than corresponding stripline type components. Point-to-multipoint broadband wireless communication applications require both low-loss design and compact packaging.

SUMMARY OF THE INVENTION

In accordance with preferred embodiments of the invention, there is provided an array antenna. The array antenna has a plurality of radiating elements, each element radiating electromagnetic radiation into a region of space defined about a primary radiation direction. The array antenna, furthermore, has a stripline network for feeding each of the radiating elements and also a waveguide power splitter for coupling power into the stripline network.

In accordance with alternate embodiments of the invention, the array antenna may also have a choke flange substantially surrounding the radiating elements in a plane transverse to the primary radiation direction. A radome may be provided for protection of the radiating elements from ambient conditions.

In accordance with yet further embodiments of the invention, the plurality of radiating elements may be rectangular slots. The waveguide power splitter may include a waveguide characterized by a height measured between broad parallel faces of the waveguide, a septum disposed parallel to the broad faces of the waveguide, and a step discontinuity in the height of the waveguide.

The dominant polarization of the plurality of radiating elements may be changed by substitution of the plurality of radiating elements and insertion of a waveguide polarization rotator, and the azimuthal distribution of the radiation pattern of the array antenna may be changed by substitution of the choke flange by a second choke flange.

BRIEF DESCRIPTION OF THE DRAWINGS

The present invention will be more readily understood by reference to the following detailed description taken with the accompanying drawings, in which.

DETAILED DESCRIPTION OF SPECIFIC EMBODIMENTS OF THE INVENTION

Figure 1:
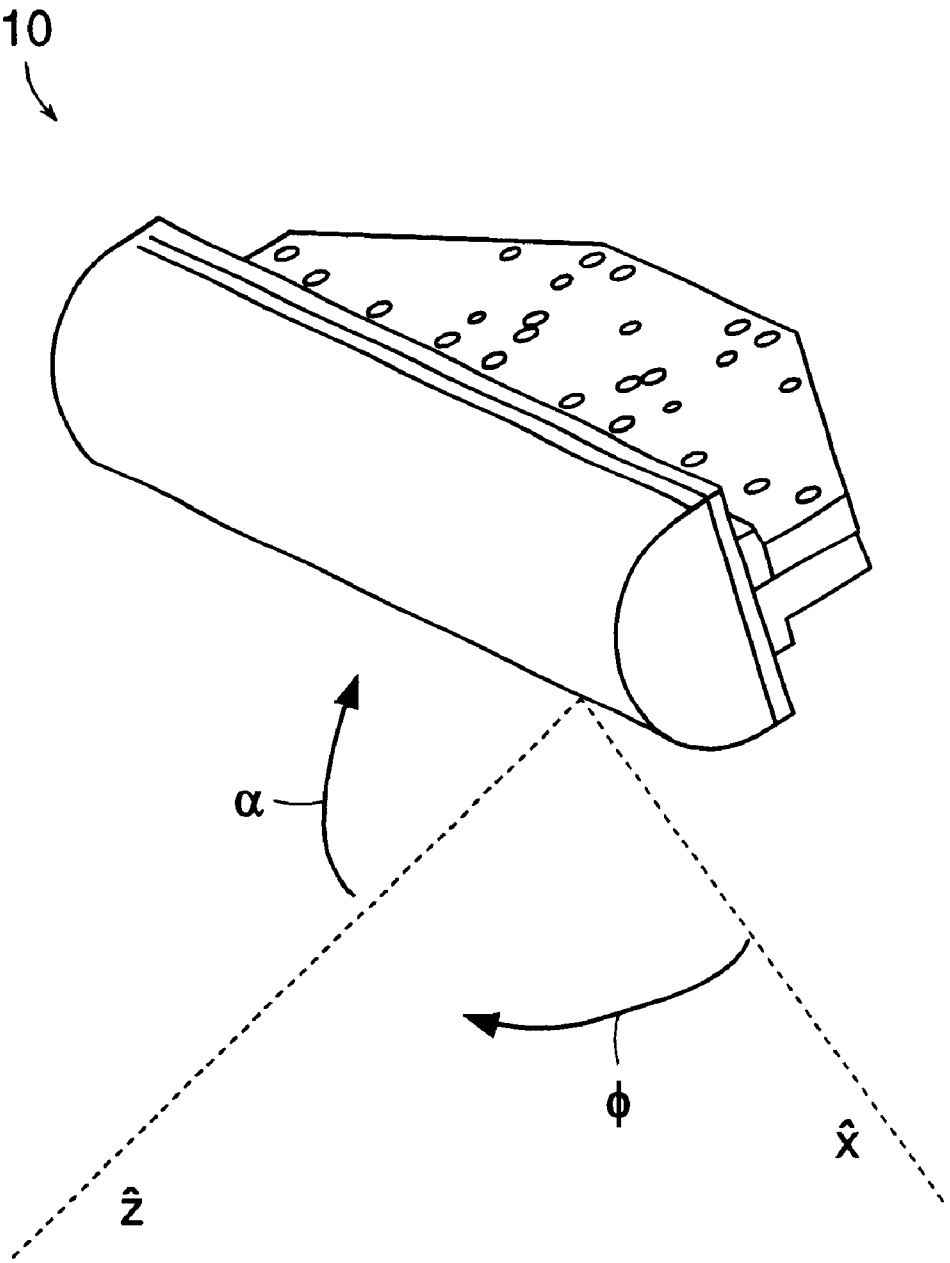
FIG. 1 is a perspective view of a hybrid waveguide/suspended stripline hub array antenna as assembled in accordance with a preferred embodiment of the present invention.
Figure 2:
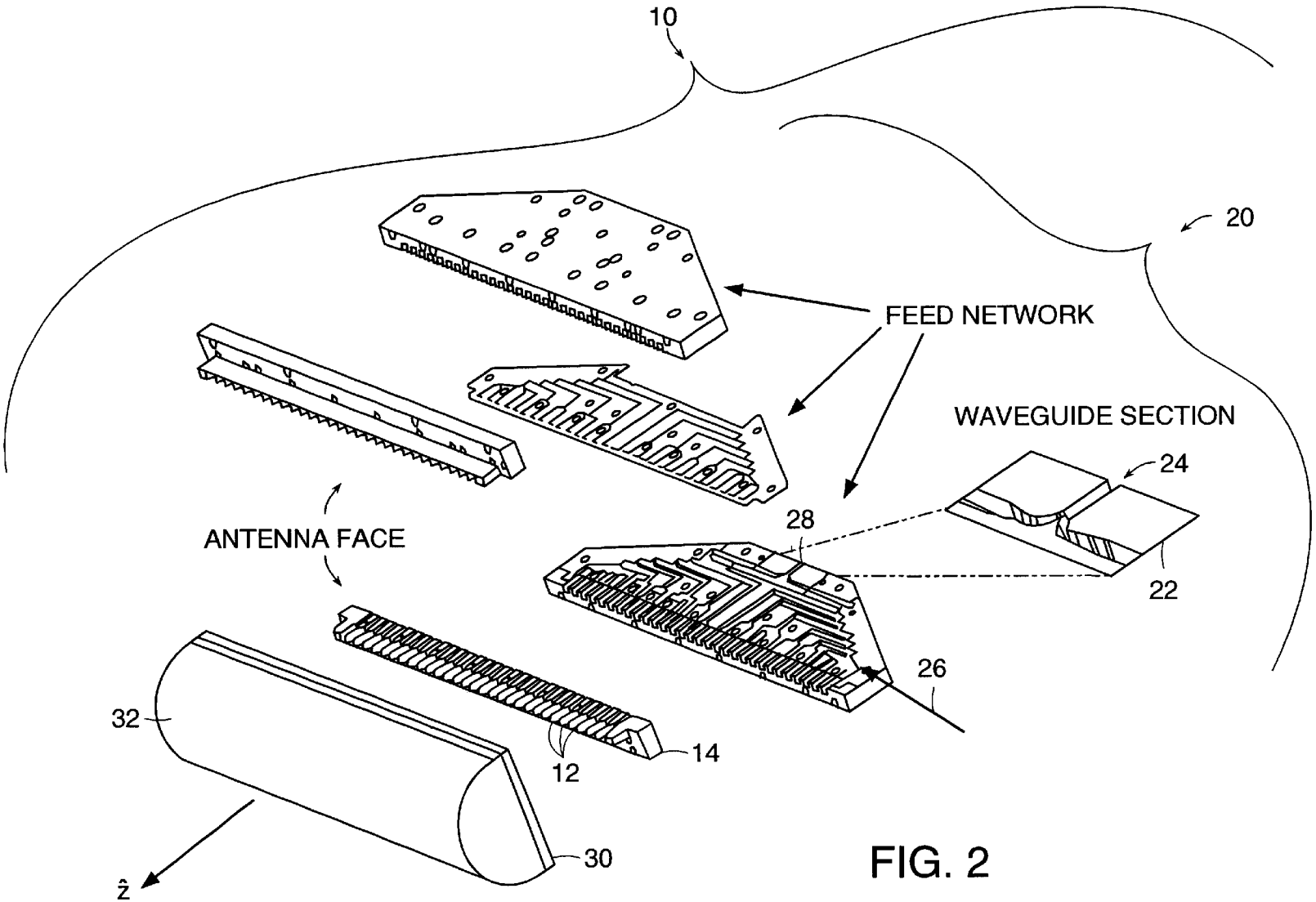
FIG. 2 illustrates the components of the hub array antenna of FIG. 1.

In accordance with preferred embodiments of the present invention, as now described with reference to FIGS. 1 and 2, an array antenna 10 is used to form an electromagnetic beam of specified radiation pattern. In this description, antenna 10 will be described as a transmitting antenna, though it is to be understood that the identical invention may be applied equally for reception of electromagnetic radiation.

A beam of electromagnetic radiation is formed (or, equivalently, received) with a controlled beamwidth in the azimuthal direction $\phi$, and a radiation pattern in elevation $\alpha$ where the radiated power is preferably approximately proportional to the square of the cosecant of the elevation angle, where the elevation angle is defined with respect to horizontal plane x-z of the antenna array.

The radiating elements of the antenna array are preferably rectangular slots 12 arranged in a linear array 14. The elements may be oriented for either vertical or horizontal polarization by providing an array module 14 that may be interchanged for a particular application. Horizontal polarization is achieved by means of a twist polarization rotator.

The radiating elements 12 are coupled to a microwave transmitter or receiver by a feed network 20. The feed network divides the microwave signal in such a manner as to maintain a constant phase between output ports while maximizing network efficiency. A first section of feed network 20 is waveguide section 22. Waveguide section 22 contains rectangular waveguide since waveguide is extremely low-loss as compared to other transmission media for frequencies above 17 GHz. However, waveguide components such as, power dividers, couplers, etc., are significantly larger than the equivalent stripline type components.

Thus waveguide section 20 is followed by stripline section 26 which distributes the microwave signal among the various radiating elements 12. A hybrid waveguide/suspended stripline network is thus formed, advantageously reducing the footprint of the network while achieving low loss. In accordance with preferred embodiments of the invention, waveguide is used for the long sections of transmission line, while stripline circuitry is used for a majority of the power division network 26.These long runs of waveguide appear near the input 28 to the antenna.

One or more power divisions are performed in waveguide by a power splitter network. Each waveguide power divider of the power splitter network is preferably broadband, and has a good input match while the output arms are substantially phase matched. Additionally, a symmetric network is exploited to minimize the radiated cross-polarized fields. To realize these features, a novel E-plane waveguide power splitter is used as described in a co-pending U.S. provisional patent application, entitled "E-Plane Waveguide Power Splitter," which is incorporated herein by reference. As described there, power division, is achieved by means of a septum in the center of the guide, as known in the art and as described, for example, in the Waveguide Handbook, ed. N. Marcuvitz, Dover Publications, (1965), at p. 353, attached hereto, which reference is incorporated herein in its entirety. An extremely broadband, low voltage-standing-wave ratio (VSWR), power divider is realized by using a small step discontinuity between the input section of the power divider and the feed waveguide as well as controlling the ratios of the input waveguide height, the step, the septum thickness and output waveguide heights, as described in the referenced provisional patent application. Power may be split in this fashion equally or unequally.

The waveguide section 22 is preferably implemented in WR-28 where the antenna is operated in the 28 GHz band. However, implementation in other wavelength ranges is within the scope of the present invention. The novel techniques described herein may be of particular advantage for high frequency waveguide networks (such as WR42 or WR28 waveguide, and smaller), where practical widths for the splitter septum are an appreciable fraction of the height of the waveguide height.

Linear array 14 of radiating elements 12 is surrounded by choke flange 30 which lies substantially in a plane transverse to direction z of symmetry of the radiation pattern produced by the antenna array. Choke 30, which is a conductor, in conjunction with radome 32, which is a dielectric such as plastic, together fulfil two functions. They control the azimuthal beamwidth of the resultant beam and protect the array elements from the ambient environment.

In further accordance with preferred embodiments, the components of the array antenna, namely the assembly of waveguide/suspended stripline network, the linear array of radiating elements, and the choke flange/radome assembly are modular and interchangeable. Choke flange/radome assemblies may provide azimuthal beam coverage of, for example, 22.5°, 45° or 90°. Similarly, the appropriate plug-in provides for either a vertical or horizontal polarization array. This makes the design more cost effective since only one feed network can be used for both polarizations and multiple azimuth beams.

To couple the energy between the waveguide section and the stripline section a waveguide to stripline section is used. Due to the spacing constraints between elements in the array, a waveguide to stripline with a 90° bend is utilized.

The output from feed network 20 excites array elements 12. Elements 12 of array 14 are rectangular apertures oriented for either vertical or horizontal polarization. By properly controlling the magnitude and phase of the output from the feed network, the radiation from these elements creates an elevation radiation pattern that closely approximates a "cosecant squared" curve. The synthesis of a beam shape of this sort is described by R. Hyneman and R. Johnson, "A Technique for the Synthesis of Shaped-Beam Radiation Patterns with Approximately Equal-Percentage Ripple", *IEEE Transactions on Antennas and Propagation,* Vol. AP-15, No. 6, p. 736, (1967), which reference is attached hereto and incorporated herein by reference.

The described embodiments of the invention are intended to be merely exemplary and numerous variations and modifications will be apparent to those skilled in the art. All such variations and modifications are intended to be within the scope of the present invention as defined in the appended claims.

What is claimed is:

1. An array antenna characterized by a radiation pattern, the array antenna comprising:

a. a plurality of radiating elements, each element radiating electromagnetic radiation into a region of space defined about a primary radiation direction, the plurality of radiating elements characterized by a dominant polarization;

b. a stripline network for feeding each of the radiating elements;

c. a waveguide power splitter network for distributing power into the stripline network; and d. a choke flange substantially surrounding the radiating elements in a plane transverse to the primary radiation direction.

2. An array antenna according to claim 1, wherein azimuthal distribution of the radiation pattern of the array antenna may be changed by substitution of the choke flange by a second choke flange.

3. An array antenna characterized by a radiation pattern, the array antenna comprising:

a. a plurality of radiating elements, each element radiating electromagnetic radiation into a region of space defined about a primary radiation direction, the plurality of radiating elements characterized by a dominant polarization;

b. a stripline network for feeding each of the radiating elements; and c. a waveguide power splitter network for distributing power into the stripline network, the waveguide power splitter network including:

i. a waveguide characterized by a height measured between broad parallel faces of the waveguide;

ii. a septum disposed parallel to the broad faces of the waveguide; and iii. a step discontinuity in the height of the waveguide.

4. An array antenna characterized by a radiation pattern, the array antenna comprising:

a. a plurality of radiating elements, each element radiating electromagnetic radiation into a region of space defined about a primary radiation direction, the plurality of radiating elements characterized by a dominant polarization;

b. a stripline network for feeding each of the radiating elements; and c. a waveguide power splitter network for distributing power into the stripline network;

wherein the dominant polarization of the plurality of radiating elements may be changed by substitution of the plurality of radiating elements and insertion of a waveguide polarization rotator between the stripline network and the plurality of radiating elements.

* * * * *